US008720717B2

(12) United States Patent
Kaanta et al.

(10) Patent No.: US 8,720,717 B2
(45) Date of Patent: May 13, 2014

(54) END CLOSURE WITH FULL PANEL OPENING

(75) Inventors: Jason M. Kaanta, Pine, CO (US); Mark A. Jacober, Arvada, CO (US); Howard C. Chasteen, Westminster, CO (US); Michael D. Richardson, Superior, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 13/364,935

(22) Filed: Feb. 2, 2012

(65) Prior Publication Data

US 2013/0200034 A1 Aug. 8, 2013

(51) Int. Cl.

| | |
|---|---|
| ***B65D 51/24*** | (2006.01) |
| ***B65D 51/22*** | (2006.01) |
| *B67B 7/14* | (2006.01) |

(52) U.S. Cl.

CPC ..... *B65D 51/228* (2013.01); *B65D 51/243* (2013.01); *B65D 51/22* (2013.01); *B67B 7/14* (2013.01)

USPC ..... 215/304; 215/303; 220/278; 220/277; 81/3.4

(58) Field of Classification Search

CPC ..... B65D 51/228; B65D 51/22; B65D 51/20; B65D 51/243; B65D 51/24; B65D 1/0253; B67B 7/14

USPC ..... 215/304, 253, 252, 250, 302, 303, 294, 215/324, 329, 257; 220/278, 277, 266, 265, 220/260, 254.8; 81/3.4

IPC ..... B65D 41/32,51/24

See application file for complete search history.

(56) References Cited

U.S. PATENT DOCUMENTS

| | | | | |
|---|---|---|---|---|
| 2,317,420 | A * | 4/1943 | Taylor | 220/265 |
| 3,159,304 | A | 12/1964 | Kolde et al. | |
| 3,401,819 | A | 9/1968 | Salamone | |
| 3,463,347 | A | 8/1969 | Kerr | |
| 3,726,432 | A | 4/1973 | Gentile | |
| 3,807,597 | A | 4/1974 | Wells et al. | |
| 3,877,604 | A | 4/1975 | Brown | |
| 3,949,692 | A | 4/1976 | DeLine et al. | |
| 3,951,331 | A | 4/1976 | Smigh et al. | |

(Continued)

FOREIGN PATENT DOCUMENTS

| | | |
|---|---|---|
| AU | 2005202056 | 12/2005 |
| EP | 0340835 | 11/1989 |
| WO | WO 2007/054568 | 5/2007 |
| WO | WO 2011/053776 | 5/2011 |

OTHER PUBLICATIONS

U.S. Appl. No. 29/382,855, filed Jan. 7, 2011, Chasteen et al.

(Continued)

*Primary Examiner* — Robert J Hicks

(74) *Attorney, Agent, or Firm* — Sheridan Ross P.C.

(57) ABSTRACT

A container for food and beverages with a fully opening end panel is provided. An end closure of the container has a generally circular end panel defined by a score line. A rotational opening tool is providing for contacting the end panel and separating the end panel from the score line upon rotation of the tool.

8 Claims, 7 Drawing Sheets

(56) References Cited

U.S. PATENT DOCUMENTS

| | | | | |
|---|---|---|---|---|
| RE28,910 | E | 7/1976 | Dalli et al. | |
| 4,047,634 | A | 9/1977 | McGeehin et al. | |
| 4,073,399 | A | 2/1978 | Lewis | |
| 4,111,325 | A * | 9/1978 | Bellamy et al. | 215/232 |
| 4,125,203 | A | 11/1978 | Sovari et al. | |
| 4,171,062 | A | 10/1979 | Allen et al. | |
| 4,181,232 | A * | 1/1980 | Bellamy et al. | 215/232 |
| 4,197,956 | A | 4/1980 | Murayama | |
| 4,241,841 | A | 12/1980 | Boller | |
| 4,337,870 | A | 7/1982 | Keeler | |
| 4,345,696 | A | 8/1982 | Guimarin | |
| 4,433,793 | A | 2/1984 | Ingemann | |
| 4,434,904 | A | 3/1984 | D'Amico et al. | |
| 4,489,864 | A | 12/1984 | Davis | |
| 4,513,875 | A | 4/1985 | Kuehn | |
| 4,527,700 | A | 7/1985 | Jupin et al. | |
| 4,527,701 | A | 7/1985 | Schaubeck | |
| 4,541,541 | A | 9/1985 | Hickman et al. | |
| 4,567,995 | A | 2/1986 | Kreiseder et al. | |
| 4,598,837 | A | 7/1986 | Kreiseder et al. | |
| 4,611,725 | A | 9/1986 | Kacalieff | |
| 4,660,735 | A | 4/1987 | Peschardt et al. | |
| 4,681,238 | A | 7/1987 | Sanchez | |
| 4,696,410 | A | 9/1987 | Kreiseder | |
| 4,709,830 | A | 12/1987 | Kreiseder | |
| 4,717,039 | A | 1/1988 | Ayyoubi | |
| 4,768,667 | A | 9/1988 | Magnusson | |
| 4,787,530 | A | 11/1988 | Edwards | |
| 4,792,054 | A | 12/1988 | Weidman | |
| 4,846,374 | A | 7/1989 | Gabrys | |
| 4,887,732 | A | 12/1989 | Matsubayashi et al. | |
| 4,901,435 | A | 2/1990 | Tahara | |
| 4,913,304 | A | 4/1990 | Corey | |
| 4,934,554 | A | 6/1990 | Edwards | |
| D315,507 | S | 3/1991 | Ochs | |
| 5,007,231 | A | 4/1991 | Ingemann | |
| 5,007,554 | A | 4/1991 | Hannon et al. | |
| 5,027,968 | A | 7/1991 | Timson | |
| 5,059,360 | A | 10/1991 | Sato | |
| 5,090,581 | A * | 2/1992 | Rose et al. | 215/48 |
| 5,103,973 | A | 4/1992 | Sato | |
| 5,129,530 | A | 7/1992 | Fuchs | |
| 5,129,773 | A | 7/1992 | Shock | |
| 5,161,713 | A | 11/1992 | English | |
| 5,167,338 | A | 12/1992 | Kick | |
| 5,193,704 | A | 3/1993 | Kick | |
| 5,199,591 | A | 4/1993 | Thibeault et al. | |
| 5,205,430 | A | 4/1993 | Valyi | |
| 5,261,548 | A | 11/1993 | Barker et al. | |
| 5,269,432 | A | 12/1993 | Beckertgis | |
| 5,328,313 | A | 7/1994 | Saunders | |
| 5,383,582 | A | 1/1995 | Baxter et al. | |
| 5,402,921 | A | 4/1995 | Forsyth et al. | |
| 5,421,472 | A | 6/1995 | Beckertgis | |
| 5,505,326 | A | 4/1996 | Junko | |
| 5,522,521 | A | 6/1996 | Nagashio | |
| 5,555,992 | A | 9/1996 | Sedgeley | |
| 5,562,226 | A | 10/1996 | Valyi et al. | |
| 5,566,850 | A | 10/1996 | Forsyth et al. | |
| 5,660,290 | A | 8/1997 | Hayes | |
| 5,692,633 | A | 12/1997 | Gordon | |
| 5,711,447 | A | 1/1998 | Plester | |
| 5,738,236 | A | 4/1998 | Brun | |
| 5,758,793 | A | 6/1998 | Forsyth et al. | |
| 5,762,230 | A | 6/1998 | Policappelli | |
| 5,850,951 | A * | 12/1998 | Hayes | 222/525 |
| 5,947,315 | A | 9/1999 | Valyi et al. | |
| 5,947,318 | A | 9/1999 | Palm | |
| 6,059,137 | A | 5/2000 | Westwood et al. | |
| 6,158,608 | A | 12/2000 | Schlattl | |
| 6,206,222 | B1 | 3/2001 | Cudzik | |
| 6,206,227 | B1 | 3/2001 | Ferri | |
| 6,216,904 | B1 | 4/2001 | Cagan | |
| 6,431,384 | B1 | 8/2002 | Dubach | |
| 6,450,358 | B1 | 9/2002 | Berro | |
| 6,626,314 | B1 | 9/2003 | McHenry et al. | |
| 6,739,471 | B2 | 5/2004 | Goetz et al. | |
| 6,755,315 | B1 | 6/2004 | Mueller | |
| 6,763,963 | B1 | 7/2004 | Martin | |
| 6,772,901 | B2 | 8/2004 | Witt | |
| 6,793,087 | B2 | 9/2004 | Dyren | |
| 6,817,819 | B2 | 11/2004 | Olson et al. | |
| 6,851,568 | B2 | 2/2005 | Herrmann | |
| 6,851,576 | B2 | 2/2005 | Dubach | |
| 6,883,689 | B2 | 4/2005 | Odet | |
| 6,910,598 | B2 | 6/2005 | Gotz et al. | |
| 7,152,766 | B1 | 12/2006 | Walsh et al. | |
| 7,178,683 | B2 | 2/2007 | Birkmayer et al. | |
| 7,198,168 | B2 | 4/2007 | Mizuma | |
| 7,198,170 | B2 | 4/2007 | Herr | |
| 7,237,698 | B2 | 7/2007 | Jackman | |
| D576,878 | S | 9/2008 | Brashear | |
| D582,275 | S | 12/2008 | Reed et al. | |
| 7,513,381 | B2 | 4/2009 | Heng et al. | |
| 7,549,547 | B2 | 6/2009 | Herr et al. | |
| D606,864 | S | 12/2009 | Robinson | |
| 7,823,740 | B2 | 11/2010 | Perra | |
| D632,958 | S | 2/2011 | Fuchs | |
| D636,265 | S | 4/2011 | Gartner | |
| 7,950,542 | B2 | 5/2011 | Steadman | |
| 2001/0022304 | A1 | 9/2001 | Roche | |
| 2003/0010781 | A1 * | 1/2003 | Odet | 220/258.2 |
| 2003/0213803 | A1 | 11/2003 | Chasteen | |
| 2004/0188440 | A1 | 9/2004 | Schlattl et al. | |
| 2006/0151421 | A1 | 7/2006 | Rho | |
| 2007/0017891 | A1 * | 1/2007 | Herr et al. | 215/228 |
| 2007/0095835 | A1 | 5/2007 | Lohrman et al. | |
| 2007/0164026 | A1 | 7/2007 | Morrissey et al. | |
| 2008/0156802 | A1 | 7/2008 | Yauk et al. | |
| 2008/0237178 | A1 | 10/2008 | Laburu | |
| 2008/0302752 | A1 | 12/2008 | Farrar et al. | |
| 2010/0059516 | A1 | 3/2010 | Parker et al. | |
| 2010/0258563 | A1 * | 10/2010 | Parrinello et al. | 220/270 |

OTHER PUBLICATIONS

Notice of Allowance for U.S. Appl. No. 29/382,855, mailed Aug. 15, 2012, 8 pages.

* cited by examiner

END CLOSURE WITH FULL PANEL OPENING

FIELD OF THE INVENTION

The present invention relates generally to end closures for food and beverage containers. More specifically, the present invention relates to an end closure for a container having a removable panel and a rotatable tool for removing the end panel.

BACKGROUND

Containers and more specifically metallic beverage containers are typically manufactured by interconnecting a beverage container end closure to the neck of a beverage container body. In some applications, an end closure may be interconnected by double seaming on both a top side and a bottom side of a container body. More frequently, however, a beverage container end closure is interconnected on a top end of a beverage container body which has been drawn and ironed from a flat sheet of blank material such as aluminum. The end closure is typically "double seamed" to the neck of the container to form an airtight seal. It is generally known to provide end closures for beverage containers which utilize an opening device for selectively opening a portion of the end closure. For example, pull tabs or stay on tabs ("SOT") generally include a nose and a tail portion and a rivet which interconnects the pull tab to the upper surface of the end closure. Upon opening, the SOT is retained on the end closure to prevent littering.

Conventional beverage container end closures with SOT's generally suffer from low, inconsistent, and/or uneven flow rates as the contents in the container are poured due to the fact that these end closures provide a single opening area of predetermined size. Conventional container end closures are generally designed for pouring the container contents, with little or no consideration given to inward air flow needed for the volume exchange that facilitates smooth and consistent pouring. Furthermore, conventional end closure openings do not contemplate a method and device for at least partially resealing a container once it has been scored or opened, nor are they suitable for storing foodstuffs which require a larger opening for removal.

The following references are hereby incorporated by reference in their entireties: U.S. Pat. No. 7,549,547 to Herr et al., which discloses a tamper-evident closure with an inner sealing disk and an outer closure, U.S. Pat. No. 3,401,819 to Salamone, which discloses a container with a screw cap wherein the container is opened by screwing the cap downwardly, U.S. Pat. No. 5,947,315 to Valyi et al., which discloses a container with an inner closure and central portion covering the access opening of the container, U.S. Pat. No. 4,934,554 to Edwards, which discloses a lid with hook members surrounding a mouth of a container for fracturing the lid, U.S. Pat. No. 3,726,432 to Gentile, which discloses a rotatable lid for severing the dispensing portion of a cylindrical container. WO 2007/054568 to Parker discloses a substantially cylindrical beverage container with a pre-scored line and an opening device and is hereby incorporated by reference in its entirety. Known devices, however, fail to disclose or contemplate various novel features of the present invention as described herein.

SUMMARY OF THE INVENTION

Accordingly, the present invention relates to a novel system, device, and methods for a fully openable end closure for a container. As used herein, the term container will be recognized to any number of containers suitable for storing food, drink, and the like, including metallic, plastic and composite containers made of any variety of materials. Containers for use with the present invention are contemplated as comprising, but are not limited to, pressurized containers (e.g. carbonated beverage containers) and non-pressurized containers (e.g. food and non carbonated drink containers).

In various embodiments, the present invention comprises a rotating or rotational tool for opening an end panel of a container. In a particular embodiment, a generally cylindrical shaped container is provided with a generally circular end closure comprising at least one score line which is severed to allow full panel opening. The score line enables a pressurized or secure seal in at least a first state, but is capable of being predictably severed by additional components of the device. The score line is, in at least one embodiment, provided within a folded bearing surface positioned proximate to the peripheral edge of the end closure. The folded bearing surface may extend to or otherwise be connected to a peripheral curl for securing the panel to the container body, and is provided to reduce a sharp edge and the likelihood of injury to a user.

In various embodiments, a rotating, hand-held removal tool is provided to selectively remove the end closure. The tool may be comprised of a variety of injection molded plastics, metallic materials or composites and is provided with at least one inclined feature or ramp. The at least one ramp of the rotating tool is provided such that when a rotational force is applied to the rotating tool, the ramp contacts a portion of the panel and severs the score line, lifting the panel in an upward direction (i.e. a vertical upward direction, opposite the general direction of the force of gravity). In one embodiment, when substantially all of the score line is severed, the rotating tool and contained panel are completely removable from the container, providing access to container contents, and eliminating the necessity of the user touching the end panel with the associated sharp edges.

In a preferred embodiment, the end closure and rotating tool may be re-applied to the container subsequent to separation of the score line. In this embodiment, the re-applied end closure may not necessarily provide an air-tight or hermetically sealed fit, but may generally secure contents and prevent the unwanted entrance of foreign objects.

One of skill in the art will recognize that the present invention is not limited to any particular number of ramps or removal devices. Accordingly, while only a single ramp feature may be provided, a plurality of ramps may be provided to reduce the requisite rotation of the tool needed to detach the end panel. End panels of the present invention may comprise as few as one opening area for ramp entry and as many as thirty six. Opening areas (i.e. sealed areas provided for initial positioning of a ramp feature), may comprise a radial angle ranging from approximately 5 degrees to approximately 330 degrees with a preferred range generally between about 100, and 150 degrees. In one embodiment, opening areas comprise a radial angle of approximately 120 degrees.

One of ordinary skill in the art will recognize that the degree of rotation of a tool required to open an end panel will generally be dictated by the number and spacing of ramps provided. Accordingly, where four ramp features are provided, the tool may only need to be rotated 90 degrees into to sufficiently sever a score line. Similarly, in an embodiment where only two ramp features are provided, at least approximately 180 degrees of rotation may be required to sever the score line.

In various embodiments, the present invention comprises a safety fold extending around a perimeter edge of the container panel. The safety fold is positioned above and internal to the score edge. Accordingly, subsequent to severing the score line and removing the end panel, a folded safety portion having a smaller internal diameter than the score line will be positioned proximal to a user, thus reducing risk of contact and injury with the score edge.

In various embodiments, the present invention comprises a rivet for securing a rotational removal tool to an end panel. For example, a rivet may be disposed in the center of an end panel and the rotational removal tool secured thereto. The rivet may serve to guide rotation of the tool and/or ensure that the panel and tool are removed as a unit. Furthermore, the rivet assures that the removal tool is not inadvertently disconnected from the container end closure during transportation, stacking, etc.

Rotating removal tools of the present invention may be provided with a storage ledge and retaining snaps. In various embodiments, storage ledges of the present invention comprise at least one portion with a diameter less than the diameter of the end panel, thus enabling the end panel to be retained within the tool when removed. Accordingly, embodiments of the present invention provide for a removable full panel opening end closure, and a rotating tool which allows the entire panel to be removed from the container as a unit. Retaining snaps are provided in various embodiments to snappingly secure the ring to the container. Retaining snaps may secure the ring to the container prior to and/or subsequent to separation of a score line and removal of the end panel.

Although features of the present invention are contemplated for use in a variety of food and beverage container, a particular embodiment contemplates use with a pressurized beverage container, wherein the internal pressure of the container assists in removal operations. As described herein, ramp features provided on a rotating tool in one embodiment apply an upward force upon a peripheral portion of the end panel, thereby upwardly severing the end panel at the score line from the remainder of the panel structure. In one embodiment, the container comprises pressurized contents, which provide an additional upward force upon the end panel, thereby assisting scoring operations and helping ensure complete severance of the score line about a 360 degree arc.

One of skill in the art will recognize that features of the present invention may comprise and/or be constructed of various known materials suitable for food and beverage containers. In one embodiment, the container and end panel are comprised of drawn and ironed aluminum and the rotating tool comprised of a known injection molded plastic. It will be expressly recognized, however, that various known materials in the art such as aluminum alloys, tin, steel, laminated and other materials may be employed without violating or exceeding the spirit or scope of the invention.

In one embodiment, a container with a selectively removable full panel opening is provided, the container comprising a substantially cylindrical container body with a closed bottom and an end closure interconnected to the container body. The end closure comprises an end panel which is selectively separable from the remainder of the container body about a score line, the score line positioned proximate to the peripheral edge of the end closure panel. Further, an opening device rotatable relative to the container body and adapted for separating the score line and removing the end panel is provided. The opening device may comprise a ramp for contacting at least one lobe extending from a portion of the end panel and separating the end panel from the container body about the score line.

In an additional embodiment, a container end closure with a peripheral curl adapted for interconnection to a neck of a container is provided, the end closure comprising a chuck wall adjacent to said peripheral curl, a countersink having a safety fold interconnected to said chuck wall, at least a portion of the countersink comprising a bearing surface, and an inner panel wall adjacent to said countersink. A removable central panel is provided adjacent said inner panel wall, wherein said inner panel wall and said removable central panel are separable from said countersink about a circular score line. A generally circular shaped opening device is also provided in communication with said bearing surface and comprising a helical ramp for contacting the central portion of the end panel and separating the entire end panel from the end closure.

In one embodiment, a method of selectively removing a full panel opening from a container is provided. The method comprises providing a generally cylindrical container body having a top portion and a bottom portion, the top portion having a neck and the bottom portion comprising a closed bottom and defining a volume therebetween, providing an end closure with a peripheral curl double seamed to said neck, a chuck wall adjacent to said peripheral curl, a countersink having a safety fold interconnected to said chuck wall, at least a portion of the countersink comprising a bearing surface, an inner panel wall adjacent to said countersink, a removable central panel adjacent said inner panel wall, wherein said inner panel wall and said removable central panel are separable from said countersink about a circular score line. Additionally, a generally circular opening device adapted to engage a portion of the end closure is provided. The opening device is then selectively aligned with the end closure and the opening device is secured to the end closure by applying a combination of downward force and rotational movement. Rotation is then applied to the opening device to achieve complete separation of the score line, and the opening device and the end panel are removed from the container. After removal, the opening device and end panel may be selectively reapplied to the container.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as, in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
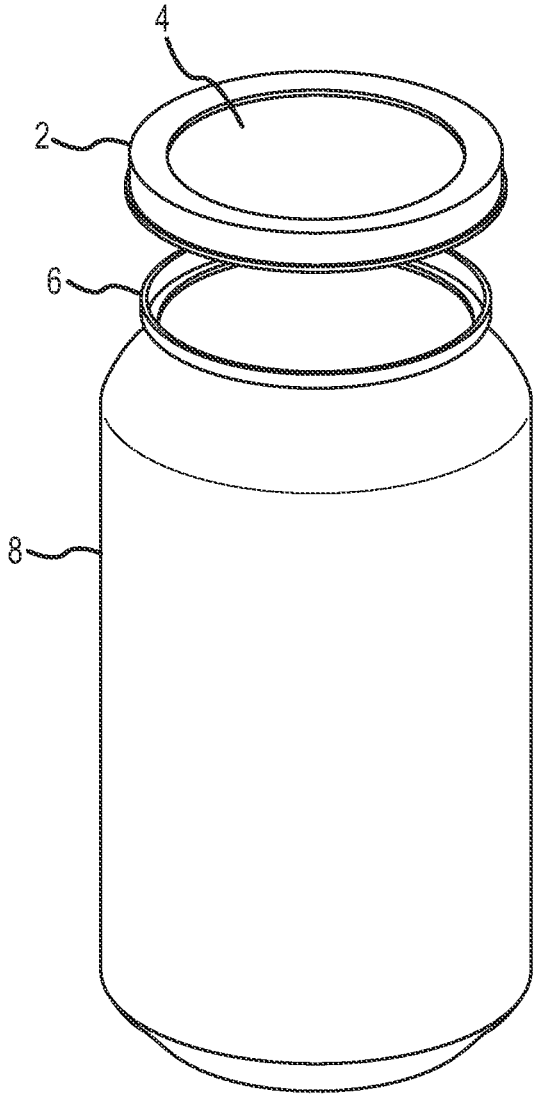
Figure 2:
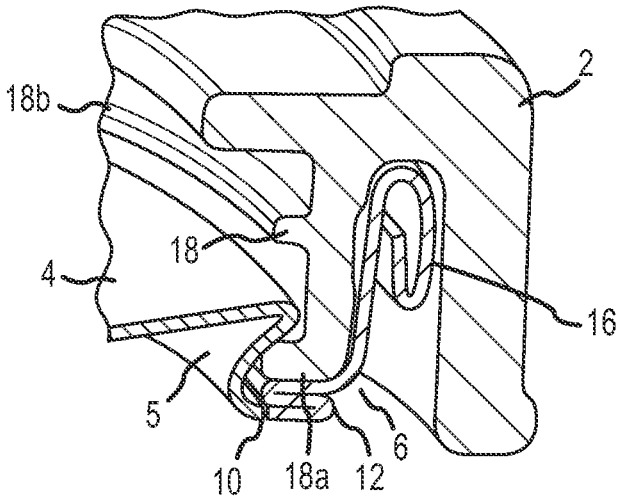
Figure 3:
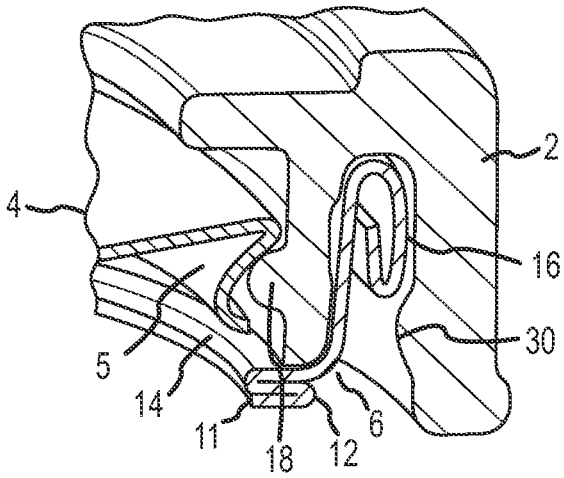
Figure 4:
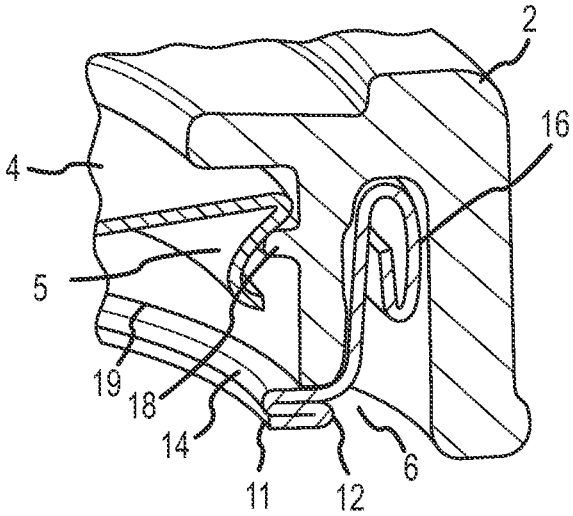
Figure 5:
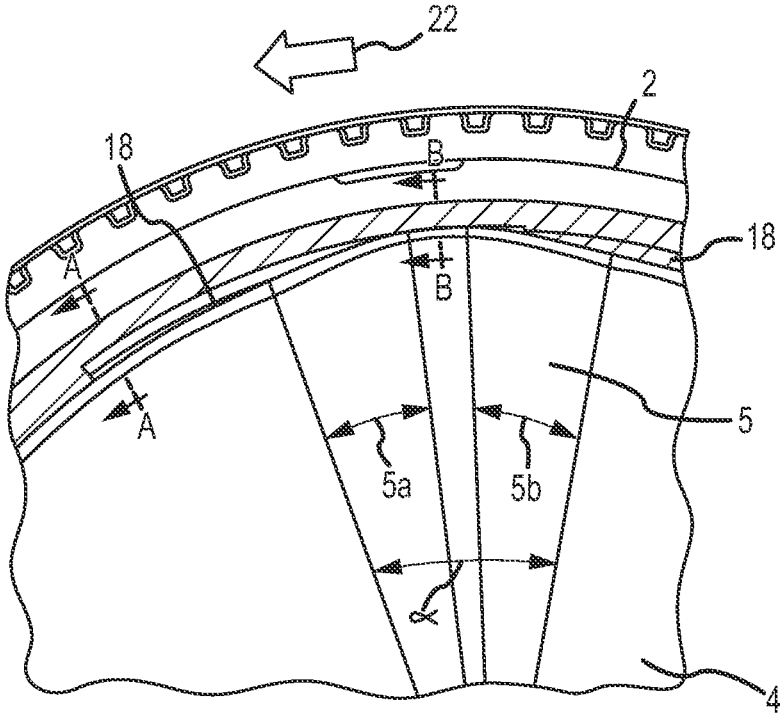
Figure 5A:
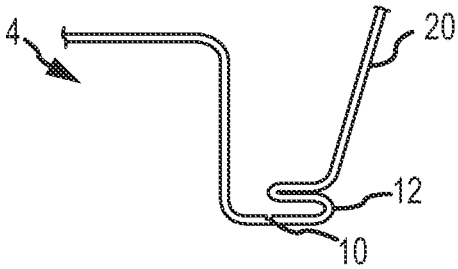
Figure 5B:
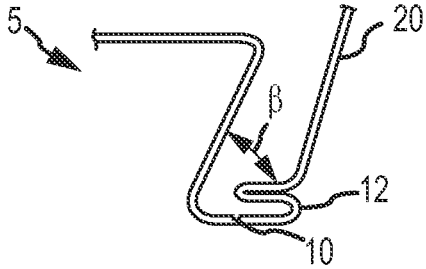
Figure 6:
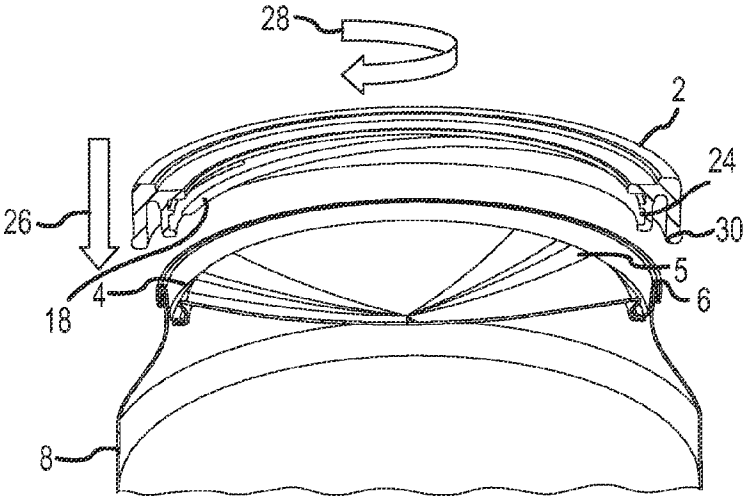
Figure 7:
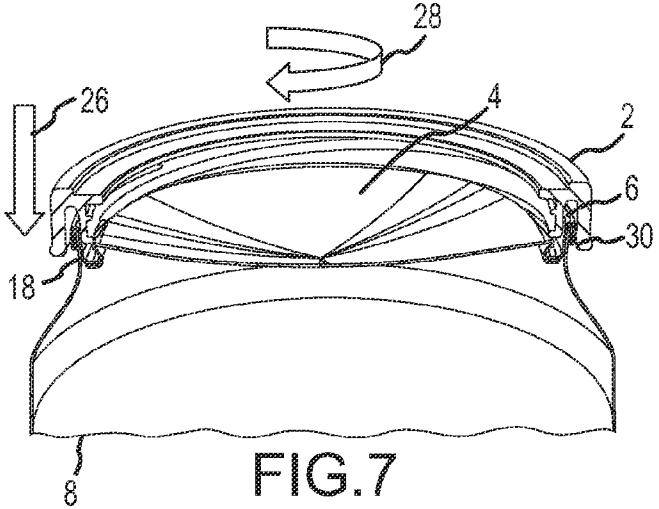
Figure 8:
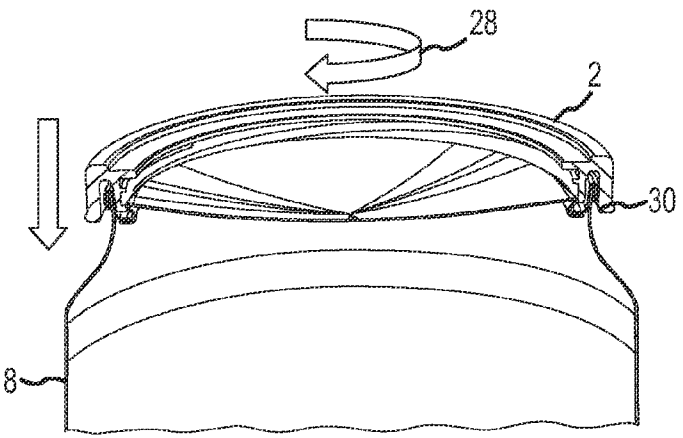
Figure 9:
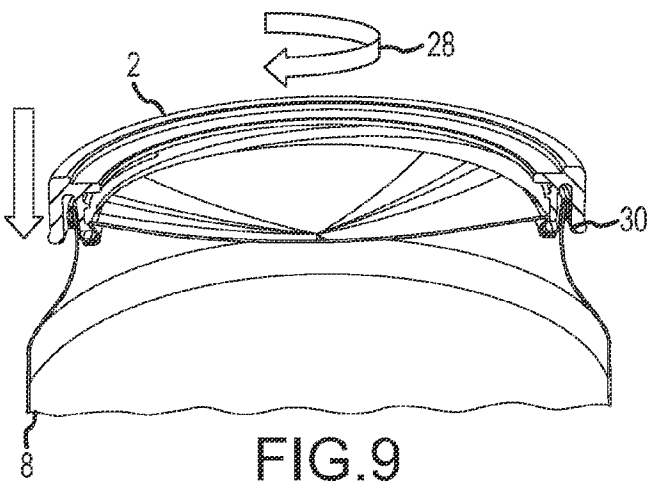
Figure 10:
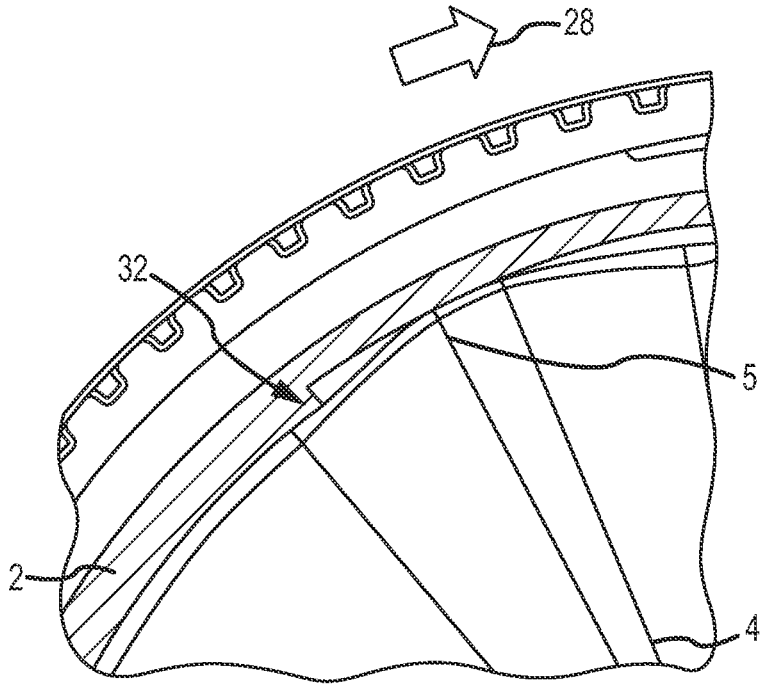
Figure 11:
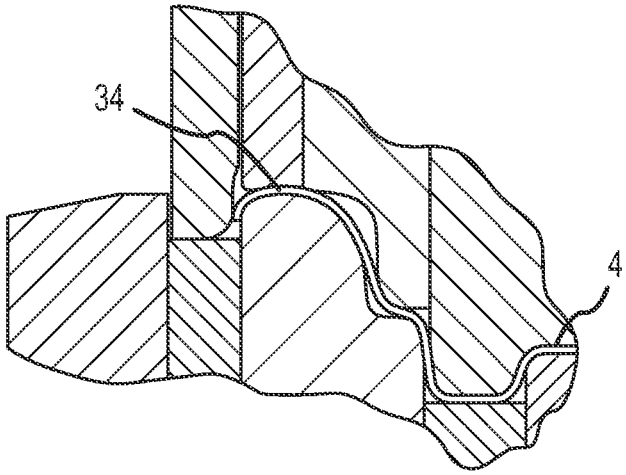
Figure 12:
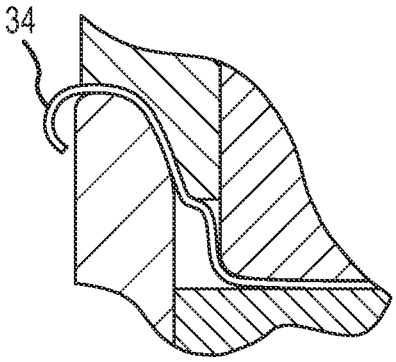
Figure 13:
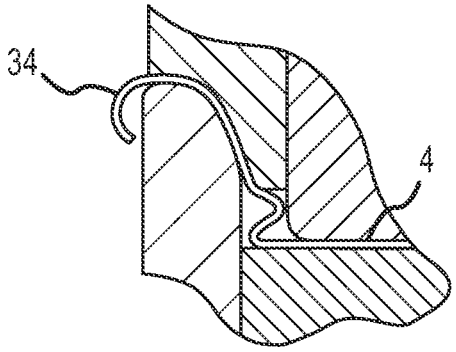
Figure 14:
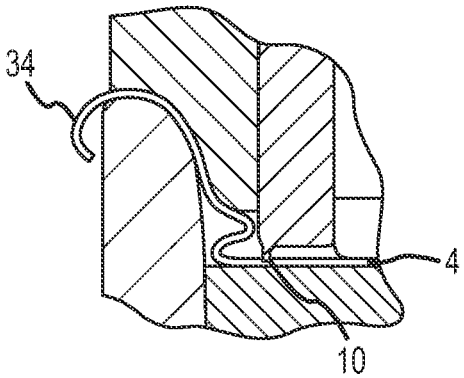
Figure 15:
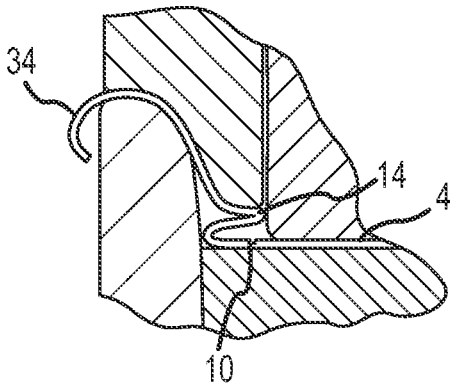
Figure 16:
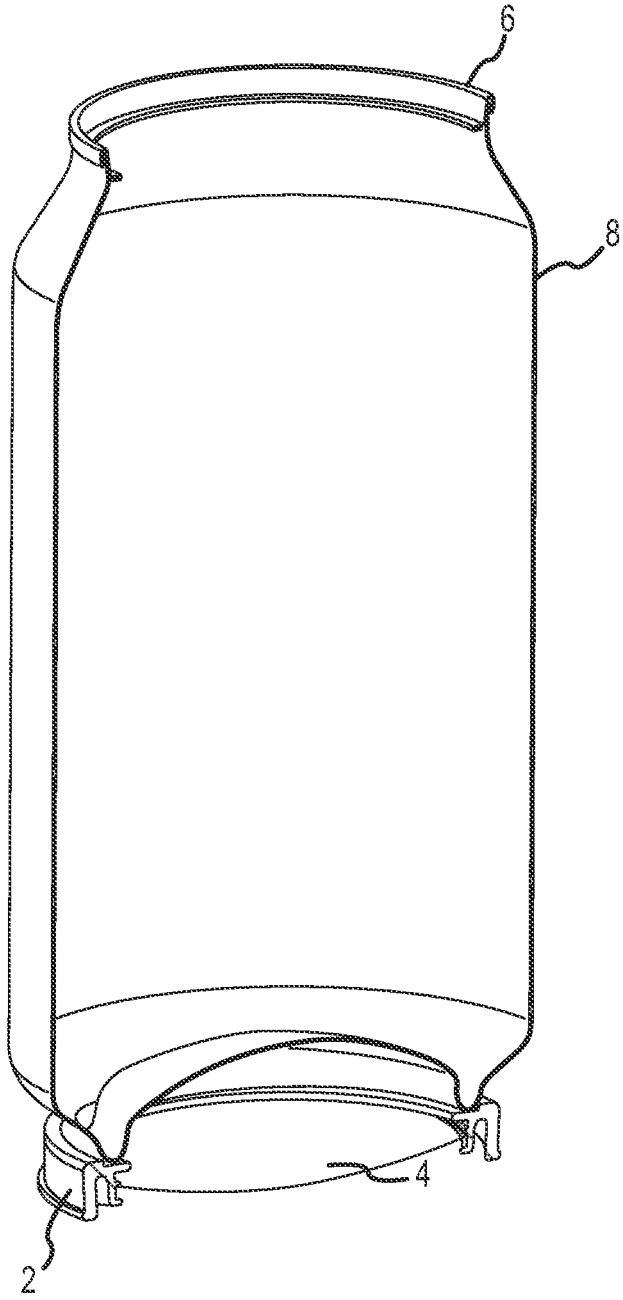

FIG. 1 is a front perspective view of one embodiment of a container with a full panel opening;

FIG. 2 is a partial cross-sectional view of one embodiment of a full panel opening device;

FIG. 3 is a partial cross-sectional view of one embodiment of a full panel opening device;

FIG. 4 is a partial cross-sectional view of one embodiment of a full panel opening device;

FIG. 5 is a top plan view of one embodiment of a full panel opening device;

FIGS. 5A-5B are partial cross-sectional views of one embodiment of a full panel opening device;

FIG. 6 is a partial cross-sectional view illustrating the installation of a rotational tool;

FIG. 7 is a partial cross-sectional view illustrating the installation of a rotational tool;

FIG. 8 is a partial cross-sectional view illustrating the installation of a rotational tool;

FIG. 9 is a partial cross-sectional view illustrating the installation of a rotational tool;

FIG. 10 is a top plan view of various features of an end panel and rotational tool;

FIG. 11 is a cross-sectional view of a forming process of the present invention;

FIG. 12 is a cross-sectional view of a forming process of the present invention;

FIG. 13 is a cross-sectional view of a forming process of the present invention;

FIG. 14 is a cross-sectional view of a forming process of the present invention;

FIG. 15 is a cross-sectional view of a forming process of the present invention;

FIG. 16 is a cross-sectional perspective view of a container with a full opening end closure according to one embodiment.

The following is a brief listing of features as shown and described:

2 Rotational tool
4 End panel
5 Panel cam lobe
6 Sealing portion
8 Container body
10 Score
11 Scored edge
12 Folded bearing surface
14 Safety fold
16 Cover hook of double seam
18 Inclined ramp
19 Storage ledge
20 Chuck wall
22 Opening direction
24 Opening area
26 Installation force
28 Rotational installation force
30 Retaining snap
32 Installation stop feature
34 Peripheral curl

DETAILED DESCRIPTION

The present invention has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, can be modified in numerous ways within the scope and spirit of the invention, the invention being measured by the appended claims and not by the details of the specification.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning Finally, unless a claim element is defined by reciting the word "means" and a function without the recital of any structure, it is not intended that the scope of any claim element be interpreted based on the application of 35 U.S.C. §112, sixth paragraph.

Referring now to FIGS. 1-16, features of a container with a full panel opening according to various embodiments of the present invention are shown. It should be understood that the drawings are not necessarily to scale. In certain instances, details that are not necessary for an understanding of the invention or that render other details difficult to perceive may have been omitted from these drawings. It should be further understood, however, that the invention is not limited to the particular embodiments illustrated in the drawings.

As shown in FIG. 1, a full opening end panel 4 for a container having a body 8 comprises a ring or rotational tool 2 for detaching the end panel 4 from a sealing ring portion 6. FIG. 1 depicts the end panel 4 and rotational tool 2 detached from the container body 8 for illustration purposes. However, as appreciated by one skilled in the art, the end panel 4 is initially attached to a sealing ring portion 6. The sealing ring portion 6 is further attached to the can body 8 via a peripheral curl and double seaming or similar known means for interconnecting an end closure to a neck of a can body. Accordingly, an end closure comprising an end panel 4 and sealing ring portion 6 is depicted in a separated state. In one embodiment a score line is provided at or near the attachment point of the panel 4 with the sealing ring portion 6. The panel 4 may be separated from the sealing ring portion 6 by selective rotation of the tool 2, which provides a force to initiate the propagation of the score and removal of the panel. The panel 4 is thereafter retained within the rotational tool 2, allowing the panel and the tool to be removed and optionally replaced as a single unit.

Referring now to FIGS. 2-4, detailed cross-sectional views of various features of the present invention are provided. More specifically, the general sequence of an opening procedure of a fully opening end closure according to one embodiment is shown. For the purposes of illustration, FIGS. 2-4 depict the panel 4, sealing ring portion 6 and associated features as stationary objects with the tool 2 moving in a counter-clockwise direction relative thereto. While a preferred embodiment of the present invention teaches providing ramp portions consistent with conventional right-hand threads, it will be expressly recognized that the invention is not so limited. Thus, while it is generally preferable to provide a fully removable panel that is removed by counter-clockwise rotation, less conventional left-hand thread features may alternatively be provided. Alternatively, a non-rotational tool is contemplated as well which could be tilted in a given direction to facilitate opening.

FIG. 2 depicts an end closure in an initial sealed state with the panel 4 secured to the sealing ring portion 6 via an unbroken score 10. A rotational tool 2 is provided with an inclined ramp feature 18. One or more inclined ramp features 18 are provided along an internal circumference of the tool 2 and may extend helically therein. Accordingly, an additional ramp portion 18*b* is shown in FIG. 2, upon which at least a portion of the panel will ascend upon rotation of the tool.

In the initial position, a lower portion of the ramp 18*a* is shown disposed generally beneath a peripheral portion of the panel 4, wherein the peripheral portion comprises a panel cam lobe 5. Panel cam lobes 5 are provided in various embodiments to accommodate one or more ramp features 18 in their initial position (i.e. wherein the panel is sealed to the sealing ring portion 6). The tool 2 rests at least partially upon a folded bearing surface portion 12 of the sealing ring portion 6, which extends upwardly into the cover hook 16 of the double seam for securing to the container body. The container body (FIG. 1, 8) is omitted from FIGS. 2-4 for the sake of clarity.

FIG. 3 is an additional cross-sectional view of the embodiment shown in FIG. 2, wherein the panel 4 has been partially separated from the sealing ring portion 6 along the score line 10. The tool 2 has been rotated such that the ramp feature 18 has applied an upward force to the peripheral portion of the panel 4, thereby separating the panel 4 at the score 10. Preferably, the panel lobe feature 5 is of geometry such that a corresponding ramp feature 18 will apply an appropriate removal force on the lobe feature 5 and panel 4. Preferred geometries of the lobe feature 5 are described herein.

As further shown in FIG. 3, a safety fold 14 is provided to conceal the scored edge 11 which may comprise a sharp point. Accordingly, the folded bearing surface 12 comprises a safety fold 14 which resides above and extends inwardly from the scored edge 11 to protect users and consumers.

FIG. 4 is an additional cross-sectional view of the embodiment shown in FIGS. 2 and 3 wherein the tool 2 has been rotated to completely sever the panel 4 from the scored edge 11. It will be expressly recognized that the amount of rotation of the tool 2 needed to detach the panel 4 from the score 10 will be determined by the number and spacing of the ramp features 18, and the angle of the ramps. The present invention contemplates various tools 2 having any number of ramp features spaced at various different intervals. Furthermore, it is contemplated that where multiple ramp features are provided, the multiple ramp features need not be spaced symmetrically. Thus, the present invention is not limited to any particular tool 2 or any particular degree of rotation needed for separating the score line 10.

FIG. 4 depicts full rotation of the tool 2 and full separation of the panel 4 from the sealing ring portion 6. The panel cam lobe 5 is positioned at or near an apex of the ramp 18. Furthermore, the scored portion of the panel 4 is now positioned above a storage ledge 19 of the tool 2. One more storage ledges 19 may be provided within the tool to retain a detached panel 4. Accordingly, with the score line 10 completely severed, the tool 2 and attached panel 4 are positioned for removal from the sealing ring portion 6 and attached container (not shown).

FIG. 5 is a top plan view of one embodiment of the present invention. As shown, a panel 4 is attached to a tool 2 and positioned for opening of an attached container. The leading edge portion of a ramp feature 18 is shown. When the tool is rotated in an opening direction 22, a panel cam lobe 5 will contact the beginning of at least one ramp feature 18 and initiate separation of a score line. In various embodiments, panel cam lobe features 5 are provided to accommodate ramp features of specific tool 2 geometry. Score lines residing generally below the panel 4, however, comprise a score line representing the circumference of a substantially planar circle in certain embodiments. The panel feature 5 comprises a portion of the panel 4. The panel lobe feature 5 may comprise an angle $\alpha$ between approximately 20 and 40 degrees of a panel 4, the panel comprising a circle of substantially 360 degrees. In a preferred embodiment, the panel feature comprises an angle $\alpha$ of approximately 30 degrees. The panel cam lobe feature 5 preferably comprises a radius of between approximately 0.950 and 1.00 inches, and more preferably of approximately 0.968 inches. The panel cam lobe feature 5 comprises transition portions 5*a*, 5*b* between vertical panel portion and a ring ramp entry area.

FIG. 5A is a partial cross-sectional view taken along line A of FIG. 5. As shown, a vertical panel wall feature of a panel 4 is shown in relation to a folding bearing surface 12 and chuck wall 20. FIG. 5B is a partial cross-sectional view taken along line B of FIG. 5. As shown, a panel cam wall lobe angle $\beta$ is provided for interaction with a removal tool of the present disclosure. The panel cam wall lobe angle $\beta$ is preferably between approximately 4 degrees and approximately 45 degrees.

FIGS. 6-9 depict the installation of a tool 2 upon a sealed container 8 and end panel 4 combination. More specifically, FIG. 6 depicts a container body 8 with an end panel 4 affixed thereto. End panels 4 of the present invention may be secured to container bodies 8 of the present invention after the container is filled with a beverage or food stuff and through a variety of known means, including but not limited to various peripheral curls which are double seamed, and various methods related thereto. In various embodiments, the rotational tool 2 comprises at least one opening area 24, the opening area 24 comprising a portion of an internal circumference of the tool 2 between ramp features 18. The tool 2 may be applied to a sealed container/end panel combination by, for example, a capper-style machine providing a downward force 26 and rotational motion 28. The rotational motion 28 is shown as a clock-wise rotational motion. However, as previously discussed, the present invention is not limited to any single thread or ramp configuration.

FIG. 7 depicts the embodiment shown in FIG. 6 wherein the rotational tool 2 has entered into the sealing ring area and contacts the retaining snaps 30 establishing concentricity and parallelism between the tool 2 and the sealing ring portion 6. The ramp features 18 shown in FIG. 7 are still disposed generally above the panel 4. FIG. 8 depicts the embodiment of FIGS. 6 and 7 wherein the combination of the downward force 26 and rotational motion 28 have positioned the opening areas 24 to be aligned with the panel cam lobe(s) 5 and allowing the tool 2 to lower further onto the container/panel combination. FIG. 9 depicts further rotation and downward force upon the tool 2, wherein the tool 2 is rotated to a point where the panel cam lobe(s) 5 contacts an installation stop feature 32. Once the rotational tool 2 is lowered to its final installation position, one or more retaining snaps 30 secure the tool 2 to the peripheral curl until removal of the tool 2 and panel 4 is desired.

FIG. 10 is a top view of one embodiment of the present disclosure comprising an installation stop feature 32 for guiding and delimiting the installation operation of a rotational tool 2 to a container. The installation stop feature 32 is provided as a radially inward projecting feature for contacting additional elements, such as panel cam lobe(s) 5 and preventing over-rotation of the tool 2 during installation.

FIGS. 11-15 generally depict the forming process of an end closure according to one embodiment of the present invention. FIGS. 11-13 depict first, second, and third forming stations respectively, wherein the profile of the end closure for securing to a container body is initially formed. FIG. 14 depicts the formation of a score line 10 on a portion of the end closure, the score line generally defining a peripheral edge of a removable end panel 4. FIG. 15 depicts a final tooling configuration wherein a safety fold 14 is formed such that the safety fold comprises a generally rounded portion positioned above the score line 10 and extending into an area defined by the score line. One of skill in the art will recognize that the forming sequence depicted in FIGS. 11-15 allows for formation of the score 10 and subsequent formation of a safety fold positioned over the score. The sequence depicted is representative of a method of forming a container end closure according to one embodiment. It will be expressly recognized that various additional methods of formation may be employed to achieve the same or similar result of a score line 10 and safety fold 14 as contemplated by the present invention.

Referring now to FIG. 16, additional features of various embodiments of the present invention are shown. A cross-sectional view of a container having a body 8 and sealing ring portion 6 as described herein is provided. An end panel 4 and associated removal tool 2 have been separated from the container as previously described. Once removed, the separated full end panel 4 and attached tool 2 may be stacked or placed underneath the container body 8. For example, the end panel 4 and tool 2 may be used as a coaster upon which the container may rest. Portions of the tool 2 and/or end panel 4 may be formed to accommodate a specific bottom profile of the container 8. In these embodiments, it will be recognized that the tool 2 and panel 4 may not only serve as a coaster, but also provide means for stacking any number of container/end panels of the same or similar construction.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A combination of a full panel opening end closure adapted for interconnection to a neck of a container and a complementing removal tool, comprising:

a peripheral curl adapted for double seaming to a neck of the container;

a chuck wall interconnected to said peripheral curl and extending downwardly therefrom;

a countersink having a safety fold interconnected to a lower portion of said chuck wall, at least a portion of the countersink comprising a bearing surface;

an inner panel wall interconnected to said countersink;

a removable end panel interconnected to said inner panel wall, wherein said inner panel wall and said removable end panel are separable from said countersink about a circular score line;

a generally circular shaped opening device in communication with said bearing surface of said countersink and comprising a helical ramp for contacting a portion of the end panel and separating the entire end panel from the end closure.

2. The combination of claim 1, wherein the end panel is retained by the opening device after separation from the container.

3. The combination of claim 1, wherein the end panel is secured to the container body by a peripheral curl.

4. The combination of claim 1, wherein the end closure comprises a folded bearing surface for contacting a lower portion of the opening tool.

5. The combination of claim 4, wherein the end panel is retained by at least two protrusions on an internal surface of the opening device.

6. The combination of claim 1, wherein the opening device comprises at least two ramps and wherein separation of the score is achieved by not more than 180 degrees of rotation of the opening device.

7. The combination of claim 1, wherein the ramp comprises a helically extending protrusion along at least a portion of an internal surface of the opening device.

8. The combination of claim 1, wherein the end panel comprises at least eighty percent of the area defined by the peripheral curl.

* * * * *